United States Patent [19]

Bubik et al.

[11] Patent Number: 4,459,175

[45] Date of Patent: Jul. 10, 1984

[54] LONGITUDINAL WIRE PAPERMAKING MACHINE

[75] Inventors: Alfred Bubik; Hans Dahl; Herbert Holik, all of Ravensburg; Rüdiger Kurtz, Immenstaad/B; Werner Seider, Ravensburg, all of Fed. Rep. of Germany

[73] Assignee: Escher Wyss GmbH, Ravensburg, Fed. Rep. of Germany

[21] Appl. No.: 419,048

[22] Filed: Sep. 16, 1982

[30] Foreign Application Priority Data

Oct. 2, 1981 [CH] Switzerland ..... 6344/81

[51] Int. Cl.[3] ..... D21F 1/40; D21F 1/50

[52] U.S. Cl. ..... 162/297; 162/300; 162/314; 162/352; 162/364; 162/370; 162/374

[58] Field of Search ..... 162/297, 300, 301, 308, 162/312, 313, 314, 352, 364, 368, 369, 370, 202, 203, 208, 210, 211, 217, 374

[56] References Cited

U.S. PATENT DOCUMENTS

| | | | |
|---|---|---|---|
| 3,087,538 | 4/1963 | Newman, Jr. | 162/297 |
| 3,844,881 | 10/1974 | Moody | 162/297 |
| 3,846,233 | 11/1974 | Kankaanpaa | 162/301 X |
| 3,994,774 | 11/1976 | Halme et al. | 162/301 X |
| 4,146,424 | 3/1979 | Justus | 162/301 X |
| 4,361,466 | 11/1982 | Wong et al. | 162/374 X |

*Primary Examiner*—Richard V. Fisher

*Attorney, Agent, or Firm*—Werner W. Kleeman

[57] ABSTRACT

A longitudinal wire papermaking machine is disclosed wherein the longitudinal wire is guided in a dewatering region, following a pre-dewatering path, out of a wire plane downwardly over a deflection element and then upwardly over a downwardly domed or arched dewatering element towards the wire plane. The deflection element is arranged at a spacing K=approximately 15 to 80 mm from the dewatering element. The longitudinal wire is guided at the inlet section of the dewatering region, located between its outbound or run-off location at the deflection element and its lowest deflection location, over a negative pressure zone, for instance constituted by a suction chamber, which is effective at its underside. Hence, at the inlet section there is obtained a reduction in the suspension pressure and the fiber stock suspension is guided with an approximately constant total thickness lower into the dewatering region, i.e. at a relatively flat angle towards the dewatering element, so that there is avoided any backflow at the surface region of the suspension.

14 Claims, 8 Drawing Figures

LONGITUDINAL WIRE PAPERMAKING MACHINE

BACKGROUND OF THE INVENTION

The present invention broadly relates to the papermaking art and, more specifically, concerns a new and improved construction of a longitudinal wire papermaking machine.

Generally speaking, the longitudinal wire papermaking machine of the present development is of the type comprising a movable longitudinal wire and a headbox coacting therewith for the infeed of a fiber stock suspension or the like to a pre-dewatering path or zone. This pre-dewatering path is formed by a substantially horizontally extending, essentially planar section or portion of the longitudinal wire. The longitudinal wire is guided at a dewatering region following this wire section, viewed with respect to the direction of movement of the longitudinal wire, downwardly over a convex domed first deflection element and thereafter upwardly along a downwardly domed guide surface of a dewatering element, which is water pervious at least over a portion of its curved extent or course, towards an upwardly domed second deflection element. The longitudinal wire travels forwardly of the first deflection element and after the second deflection element essentially in the same wire plane.

A papermaking machine of this type has been disclosed in the commonly assigned, U.S. application Ser. No. 06/321,677, filed Nov. 16, 1981, now U.S. Pat. No. 4,417,950. With the papermaking machine described in the aforementioned application the longitudinal wire, together with an additional upper wire, is guided out of the wire plane over a guide shoe and a first deflection cylinder at the dewatering region or zone. The fiber stock suspension is dewatered upwardly already at the region of the wire plane through both of the wires which contact one another at the region of the wire plane. The resultant filtered or expressed water is removed by a catch basin or container which must be arranged between the first deflection cylinder and the dewatering roll which immerses or extends beneath the wire plane. With this arrangement, with predetermined dimensions of the dewatering region, the mounting space available for the dewatering element, which is to be designed in consideration of the largest possible wrap angle, is limited by the mounting space needed for the placement of the catch basin or container.

SUMMARY OF THE INVENTION

It is a primary object of the present invention to improve upon the previously described construction of a papermaking machine of the aforementioned type in that, there is realized a further enhancement of the dewatering action with simplified guiding of the wire and simplified construction of the papermaking machine, without appreciably altering or impairing the wire guiding and the advantageous low structural height of prior longitudinal wire papermaking machines.

Still a further significant object of the present invention is directed to a new and improved construction of a longitudinal wire papermaking machine which is simple in construction and design, possesses a compact or low structural height, is extremely reliable in operation, not readily subject to breakdown or malfunction, and requires a minimum of maintenance and servicing.

Now in order to implement these and still further objects of the invention, which will become more readily apparent as the description proceeds, the papermaking machine of the present development is manifested by the features that, the lower side or face of the longitudinal wire which faces away from the dewatering element is guided over a negative pressure zone at the inlet section or portion of the dewatering region extending between the wire outbound or run-off location located at the first deflection element and the lowest deflection location of the longitudinal wire with respect to the wire plane.

Due to the negative pressure zone effective at this inlet section the liquid pressure of the fiber stock suspension is reduced at the start of the wrap region of the longitudinal wire formed at the dewatering element, with essentially unaltered predetermined wire tension, so that there is obtained a flow-favorable entry of the fiber stock suspension into the wrap region extending along the dewatering element. Consequently, with this arrangement it is possible to freely guide the fiber stock suspension located upon the longitudinal wire, without dewatering such upwardly, over the first deflection element towards the dewatering element. Hence, on the one hand, there is not required any catch container or basin for the filtered water which is upwardly propelled away and which catch container otherwise would be arranged forwardly of the dewatering element and, on the other hand, by virtue of the reduced pressure of the fiber stock suspension there is precluded a return flow at the surface region of the fiber stock suspension which with prior art arrangements, occurred at the impact location of the fiber stock suspension at the dewatering element. Also, there is avoided an impairment in the formation of the fibers contained within the stock suspension to be dewatered which would otherwise be caused by such type of return of backflow. A further advantage of the inventive papermaking machine resides in the fact that, predicated upon the fact that there is no longer required any catch container or equivalent structure, it is possible to reduce the spacing between the first deflection element and the dewatering element, and thus, to obtain a larger wrap angle of the longitudinal wire at the dewatering element, in other words there can be arranged a larger dewatering element than was heretofore possible in the mounting space which is available by virtue of the novel design of the papermaking machine of the invention.

An advantageous manner of guiding the wire in a manner which is particularly favorable for obtaining an undetrimental dewatering action can be realized in that, the first deflection element and the dewatering element are arranged in spaced relationship from one another at a distance of approximately 15 to 80 mm, measured between their surfaces, and that the negative pressure or vacuum zone extends over the portion of the travel or contact surface of the first deflection element which merges downstream at the outbound or run-off location of the longitudinal wire with respect to its direction of movement. In particular, when the papermaking machine is designed such that the spacing between the dewatering element and the deflection element is selected to be near to the lower of both mentioned boundary values or limits there already can be obtained a possibly sufficient correction of the pressure profile or course in the downwardly deflected suspension by virtue of the negative pressure or vacuum which forms directly after the wire outbound or run-off location, so that, for instance, there is rendered superfluous the arrangement of a device which generates an additional negative pressure.

In order to attain an effective localized relief of the inlet or entry region it is advantageous if the negative pressure zone extends over the suction opening of a suction chamber which can be applied to the underside or bottom face of the longitudinal wire.

Furthermore, an embodiment of the invention can be designed such that the suction chamber possesses a flow-upstream located boundary wall which is sealingly connected with the first deflection element. In corresponding manner the negative pressure or vacuum generated by the suction chamber already is effective beginning at the wire run-off or outbound location.

According to a further design of the invention there can be attained an intentional influencing of the position and magnitude of the negative pressure zone, in accordance with the momentary operating conditions, if the suction chamber possesses a flow-upstream located boundary wall which is arranged between the first deflection element and the lowest deflection location of the longitudinal wire.

In order to appropriately influence the pressure profile or course within the wire wrap region the suction chamber can possess a flow-upstream located boundary wall which is arranged flow-upstream of the lowest deflection location of the longitudinal wire.

In order to influence the dewatering operation it is possible, on the other hand, for the suction chamber to possess a flow-downstream located boundary wall which is arranged downstream of the lowest deflection location of the longitudinal wire.

A dewatering arrangement which possesses a particularly simple compact construction, and at the same time ensures for a large wrap region which is advantageous as concerns the intensity of the dewatering operation, can be achieved in that the dewatering element is constituted by an open roll or cylinder which has a diameter of about 600 to 1500 mm.

The dewatering action which occurs at the region of the dewatering element can be upwardly enhanced if the roll contains at least one suction chamber of its own which is open towards the region of its guide surface which neighbors the negative pressure zone downstream thereof.

Since the dimensions of dewatering rolls are subject to structural limitations, it is possible to obtain a wrap region which is appreciably larger in comparison to a dewatering roll in that, the dewatering element comprises a guide portion which is stationary with respect to the longitudinal or lengthwise extending wire. This guide portion is provided at least at the region of its guide surface, neighboring the negative pressure zone downstream thereof, with throughflow openings or passages for the filtered water which is expressed upwardly during the dewatering operation, and furthermore, with at least one suction chamber of its own with which the throughflow openings or passages flow communicate.

According to a further design of the invention, the longitudinal wire can be guided at a portion or section of the dewatering region located downstream of the negative pressure zone over a pressure chamber open towards the guide surface of the dewatering element. This construction enables using a particularly simple construction of dewatering element without the need for special fittings or installed parts, and, in particular, there can be upwardly improved the dewatering of the fiber web which passes through the downstream located end of the wrap region.

According to a still further construction of the invention, it is possible when using a second wire, which conjointly with the longitudinal wire is trained or wrapped about the dewatering element, to convergingly guide this second wire towards a run-on portion of the longitudinal wire which is located downstream of the wire run-off or outbound location at the first deflection element. This second wire is convergingly guided in spaced relationship from the portion of the longitudinal wire which extends over the first deflection element. Consequently, also in the case of a twin-wire papermaking machine it is possible to obtain an undetrimentally gradual use in pressure during entry of the fiber stock suspension into the dewatering region formed between both of the coacting twin wires.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
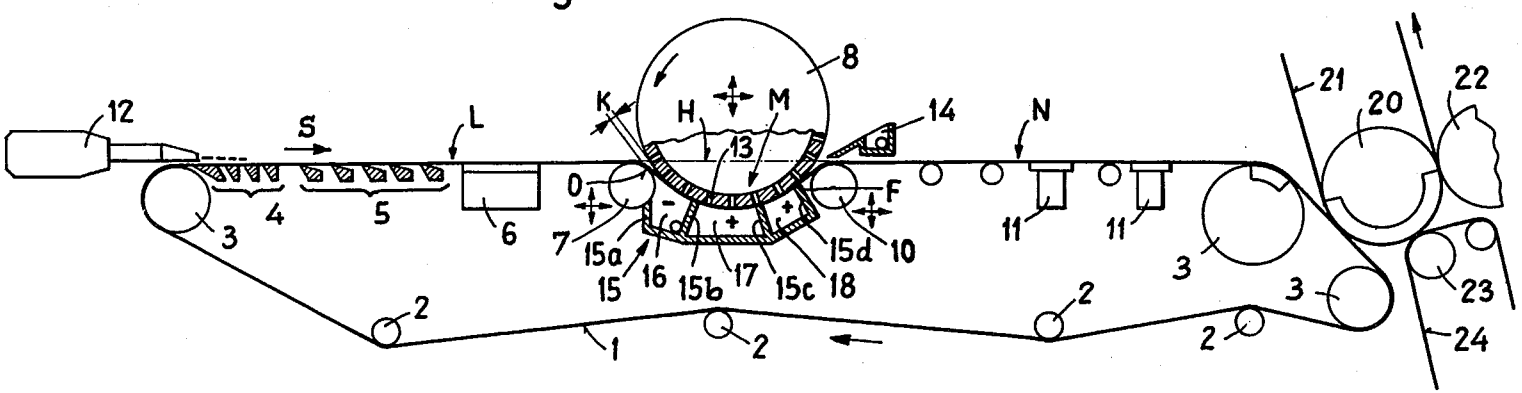
FIG. 1 schematically illustrates a longitudinal wire papermaking machine containing a dewatering region constructed according to the invention.

Describing now the drawings, it is to be understood that only enough of the construction of the papermaking machine has been depicted therein in order to simplify the illustration of the drawings and as needed for those skilled in the art to readily understand the underlying principles and concepts of the present development. Turning attention now specifically to FIG. 1, the illustrated exemplary embodiment of papermaking machine will be seen to contain an endless longitudinal or lengthwise extending wire 1 which is guided over guide rolls 2 and guide cylinders 3. During operation of the papermaking machine, this longitudinal wire 1 has a direction of movement as generally indicated by the arrow S. The upper run of the longitudinal wire 1 is guided, during its direction of movement indicated by the arrow S, by the front guide cylinder 3, through an essentially planar or flat first section or portion L which forms a pre-dewatering path, over conventional dewatering facilities or devices, such as for instance wire tables 4, foils 5 and a suction box 6 as well as over a first deflection roll 7. At the intermediate portion or section M which merges at the first portion or section L, and which intermediate portion M forms a dewatering region or zone, the longitudinal wire 1 is downwardly deflected and after partially training or wrapping about the lower outer or jacket surface of a dewatering cylinder or roll 8, is guided over a deflection roll 10. The dewatering cylinder 8 and the deflection rolls 7 and 10 are appropriately vertically and horizontally adjustable by any suitable adjustment means well known in this technology, and as has been conveniently schematically represented by the not particularly intersecting double-headed arrows. The longitudinal wire 1 is guided from the deflection roll 10 in a second planar section or region N which along with the first portion or section L is disposed essentially in a substantially horizontal wire plane H, over further suitable dewatering devices, such as for instance suction boxes 11, towards the first guide cylinder 3 located immediately after the suction boxes 11, constituting a rear guide cylinder with regard to the direction of wire movement S, and which guide cylinder 3 is constructed as a suction cylinder.

At the start of the first wire section or portion L there is located a headbox 12 which, in conventional manner, serves for the distribution of the fiber stock suspension onto the longitudinal wire 1 and for forming thereon a fiber web.

The dewatering cylinder or element 8 which, for instance, can possess a diameter of about 600 to 1500 mm, is arranged with respect to the horizontal or wire plane H so as to have a penetration depth which can amount to, for instance, 50 mm up to one-quarter of its diameter in order to attain an intensive dewatering of the pre-dewatered fiber web. As a general rule, the penetration depth usually is in the order of one-eighth of the diameter, i.e. can lie in a range of between 70 and 180 mm in accordance with the aforementioned range of diameters. The dewatering cylinder 8 is constructed as an open roll having throughflow openings or passages 13 arranged at its roll jacket or outer surface. Penetrating upwardly through the throughflow openings or passages 13 and into the interior of the cylinder or roll 8 is the so-called filtered or expressed water which is produced during the dewatering of the fiber stock suspension at the dewatering region or zone M. This water can be again propelled through the throughflow openings 13 at the circumferential region of the dewatering cylinder 8 located above the second deflection roll 10 out of the interior of the cylinder or roll towards the outside in the direction of a catch container or vat 14 which retains the water away from the dewatered fiber web.

At the wire section or portion M the longitudinal wire 1 is guided over a housing 15 which is open towards the dewatering cylinder or element 8. This housing 15 is provided with walls 15*a*, 15*b*, 15*c* and 15*d* positioned transversely with respect to the direction of movement S of the longitudinal or lengthwise extending wire 1. These housing walls 15*a*, 15*b*, 15*c* and 15*d* bound a suction chamber 16 and two pressure chambers 17 and 18 which merge downstream of the suction chamber 16 in such direction of wire movements. The flow-upstream located boundary wall 15*a* is sealingly guided at the deflection roll or element 7, whereas the walls 15*b*, 15*c* and 15*d* bear at the underside of the longitudinal wire 1. The flow-downstream located wall 15*b* of the suction chamber 16 is arranged near to the lowermost deflection location of the longitudinal wire 1 with respect to the wire plane H, so that the negative pressure zone of the suction chamber 16 extends over the major portion of the entry or inlet section of the dewatering region formed between the run-off or outbound location 0 of the longitudinal wire 1 from the deflection roll 7 and the lowest deflection location. The wall 15*c*, which separates the pressure chambers 17 and 18 from one another, is arranged at the flow-downstream located half of the deflection region of the longitudinal wire 1, whereas the flow-downstream located outer wall 15*d* essentially bears, at the region of a run-off or outbound location F of the longitudinal wire located at the outer surface or jacket of the dewatering cylinder 8, at the underside or bottom face of such longitudinal wire 1.

In accordance with the illustration of the exemplary embodiment of papermaking machine depicted in FIG. 1, the fiber stock suspension which is delivered by means of the headbox 12, is downwardly dewatered in conventional manner, preferably with increasing intensity, at the first planar section or portion L forming a pre-dewatering path. By virtue of the thus formed fiber web which becomes increasingly more compact or dense in the direction of movement S of the longitudinal wire 1 there is formed upon such longitudinal wire 1 a practically water impervious layer which, at the end region of the pre-dewatering path prevents any further downward dewatering of the fiber stock suspension. Accordingly, a portion of the fiber stock suspension with the therein distributed fibers remains upon the formed fiber layer and in conjunction therewith is guided over the deflection roll 7 in the dewatering region located at the wire section or portion M, in order to be mechanically upwardly dewatered at that location between the dewatering cylinder 8 and the longitudinal wire 1. The thus formed filtered water is received through the throughflow openings or passages 13 and/or expressed into the interior of the dewatering cylinder 8 and, subsequently, propelled off into the catch container or vat 14.

At the end of the dewatering region the now extensively dewatered fiber web is detached from the dewatering roll 8 at the wire run-off or outbound location F and is guided over the second deflection roll or element 10 for further dewatering at the second planar wire section or portion N, and subsequently, over the guide roll 3 to a pick-up region where the longitudinal wire 1 is joined with a felt band or felt 21 which is trained about a suction press roll 20. This felt band or felt 21 serves for the pick-up of the formed paper web from the longitudinal wire 1. The suction press roll 20 coacts with a counter roll 22 and a further counter roll 23, over which there is guided a wire 24.

Figure 5:
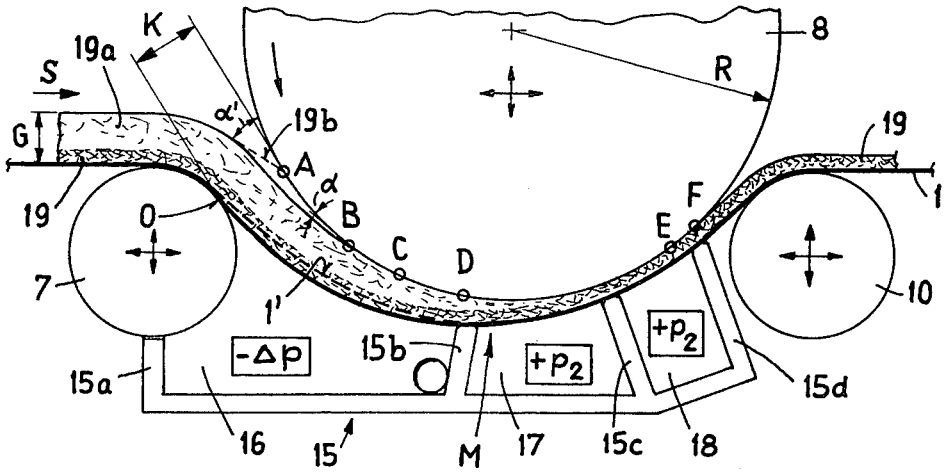
FIG. 5 illustrates a dewatering region on an enlarged scale and corresponding approximately to the showing of the arrangement of FIG. 1.

In FIG. 5 there has been illustrated in a markedly simplified showing the conditions prevailing within the dewatering region M. Specifically, the fiber web 19 bearing upon the longitudinal wire 1 and already formed in the pre-dewatering path L has been illustrated as a relatively small shaded layer upon which there is guided the non-dewatered remainder of the fiber stock suspension illustrated in the form of the layer 19*a*, over the deflection roll 7 into the inlet section or portion of the dewatering region M.

The total thickness G of the fiber stock suspension, composed of the thickness of the fiber web or layer 19 and the thickness of the liquid layer 19*a*, as a general rule, can amount up to 15 mm, and the thickness of the fiber web or layer 19 can amount to, for instance, 2 to 3 mm. In order to realize a gentle entry of the stock suspension into the dewatering region M, the deflection roll 7 and the dewatering cylinder 8 are arranged at a spacing K from one another, this spacing K being measured between their surfaces. This spacing K is equal to or greater than the total thickness G of the stock suspension by a predetermined amount. As an upper threshold of the spacing K there can be assumed approximately the five-fold of the greatest total thickness G, so that the spacing K can amount to approximately 15 to 80 mm.

Figure 6:
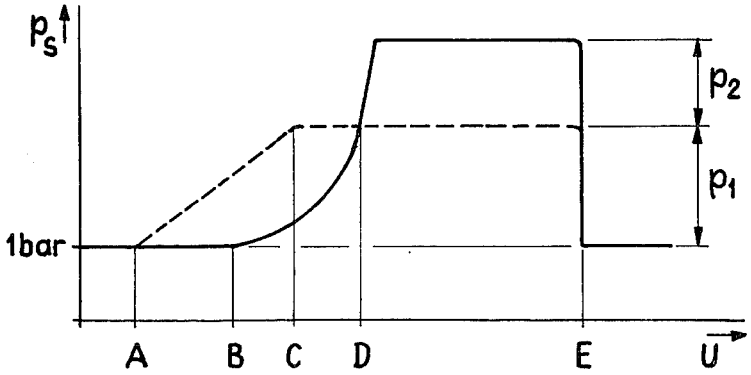
FIG. 6 is a diagram illustrating the approximate course of the suspension pressure within the dewatering region of the arrangement of FIG. 5.

In accordance with the illustration of FIG. 5, wherein the spacing K is greater than the total thickness G, and if there were not being provided the suction chamber 16 or such were not placed into operation, then the longitudinal wire 1 at the entry or inlet portion of the dewatering region would adjust itself approximately in accordance with the broken line 1'. Hence, the surface of the liquid stock suspension, indicated by a broken line **19*b*, among other things, because of the centrifugal force effective thereat, would impinge at a relatively steep angle $\alpha'$ at a relatively high located impact or impingement location A upon the dewatering cylinder or element 8, so that there could arise a damaging back or return flow at the surface region 19*b* of the fiber stock suspension which can impair the forming of the stock fibers at such surface region. In FIG. 6** there has been depicted the course or profile of the suspension pressure which regulates or adjusts itself with this arrangement, namely $$p_s = p_1 = T/R$$

by a broken line over the circumferential region U of the dewatering cylinder 8 and which is trained by the longitudinal wire 1, wherein reference character $p_1$ designates the liquid pressure resulting from the wire tension T, and reference numeral R represents the radius of the dewatering cylinder 8. As will be apparent from the showing of FIG. 6, the pressure $p_1$ increases relatively rapidly from the impact or impingement location A up to a circumferential location C and subsequently remains relatively constant up to a circumferential location E located forwardly of the outbound or run-off location F of the longitudinal wire 1, and which circumferential location E corresponds to the water line.

With the suction chamber 16 placed into operation the longitudinal wire 1 is relieved at the entry or inlet portion of the dewatering region owing to the vacuum or negative pressure $\Delta p$ effective at the region of the suction chamber 16, in that such longitudinal wire 1 is deflected out of the broken line depicted wire course 1' in the sense of a greater downward curvature towards the course of travel depicted in FIG. 5 with a full or solid line, and consequently, the run-off or outbound location O is shifted in the direction of movement S of the longitudinal wire 1 and there is reduced the pressure $p_1$ resulting from the wire tension T. In corresponding manner it is possible for the suspension to be deflected through a larger angle about the deflection roll 7 and it is delivered at a lower location into the dewatering region or zone with approximately constant total thickness G, without contacting the dewatering cylinder 8, and furthermore is guided at a relatively flat angle $\alpha$ towards an impact or impingement location B situated downstream of the impact location A.

The course or profile of the suspension pressure $p_s = p_1 + p_2$ which regulates or adjusts itself with this arrangement, has been illustrated in FIG. 6 by a solid line, wherein $p_1$ represents the liquid pressure resulting from the wire tension T, and $p_2$ represents the liquid pressure produced at the region of both pressure chambers or compartments 17 and 18. As will be apparent from the illustration of FIG. 6, the suspension pressure $p_s$ increases from the impact or impingement location B in a relatively flat starting curve up to a circumferential location D which is located above the intermediate wall **15*b*. At the subsequent circumferential regions located above the pressure chambers 17 and 18 the suspension pressure $p_s$ is increased by the pressure $p_2$. The pressure effective by means of the pressure chamber 17 can serve for augmenting the dewatering operation, whereas the pressure effective by means of the pressure chamber 18 is intended for blowing-through the throughflow openings or passages 13 located at the outer surface or jacket of the dewatering cylinder 8, in order to withdraw the filtered water internally of the dewatering cylinder 8 which is located in such throughflow openings or passages. The pressure chambers 17 and 18** also can possess different pressures $p_2$.

Figure 2:
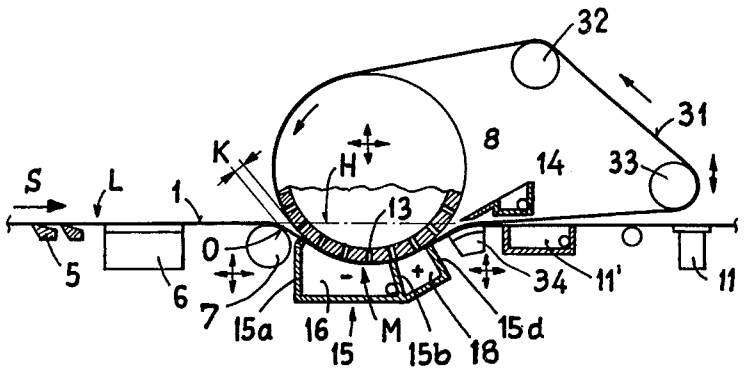
FIGS. 2, 3 and 4 are respective schematic fragmentary illustrations of papermaking machines, corresponding to the showing of FIG. 1, and each depicting a different construction of dewatering region.

With the embodiment of FIG. 2 the longitudinal wire 1 coacts with an upper second wire 31. This second wire 31 is guided over the dewatering cylinder or element 8, a guide roll 32 and an adjustable roll 33 which can be adjusted transversely with respect to the wire plane H, as has been merely schematically indicated by the double-headed arrow. Both of the wires 1 and 31 or equivalent structure are guided conjointly through the dewatering region, namely the region or section M, and over a vertical and horizontally adjustable guide shoe 34 at which both of the wires 1 and 31 separate or outbound from one another. At the inlet location of the dewatering cylinder 8 the upper wire 31 is guided such that it extends at the region of the wire plane H in spaced relationship from the portion of the longitudinal wire 1 trained about the first deflection roll or cylinder 7 and is first then convergingly joined with the longitudinal wire 1 at a run-on or inbound portion located downstream of the run-off or outbound location O.

With this embodiment the suction chamber 16 extends over the major portion of the common wrap region of both wires 1 and 31. The flow-upstream located wall **15*a* is guided in spaced relationship from the deflection roll 7 between such deflection roll 7 and the run-on or inbound portion of both wires 1 and 31 at the underside or lower face of the longitudinal wire 1. The flow-downstream located wall 15*b* of the suction chamber 16 bears, at the circumferential region of the dewatering roll 8 where there is practically terminated the dewatering of the fiber web, against the underside of the longitudinal wire 1**.

By virtue of the arrangement of the flow-upstream located wall **15*a* which is independent of the deflection roll 7, it is possible to accommodate the start of the negative pressure zone to the conditions governed in each case by the immersion or penetration depth of the dewatering cylinder 8 and/or the wrap angle of both wires 1 and 31 and to shift such into the region most favorable for the load-relief of the longitudinal wire 1. The end of the negative pressure zone is determined by the wall 15*b* arranged flow-downstream of the lowest deflection location, so that the load-relief of the longitudinal wire 1** is effective at the greatest portion of the dewatering region or zone.

In this case the reduction of the suspension pressure resulting from the wire tension and occurring in the suction zone is tolerated in favor of a pressure increase which extends gently over the entire suction zone. By means of the pressure chamber 18 there are blown-through, in the manner already described, the throughflow openings or passages 13 of the dewatering cylinder 8, through the extensively dewatered fiber web. Following the separation or parting location of both wires 1 and 31 from one another there is arranged an additional suction box 11' at the underside of the longitudinal wire 1, which augments the detachment of the fiber web leaving the dewatering region M from the upper wire 31.

Figure 3:
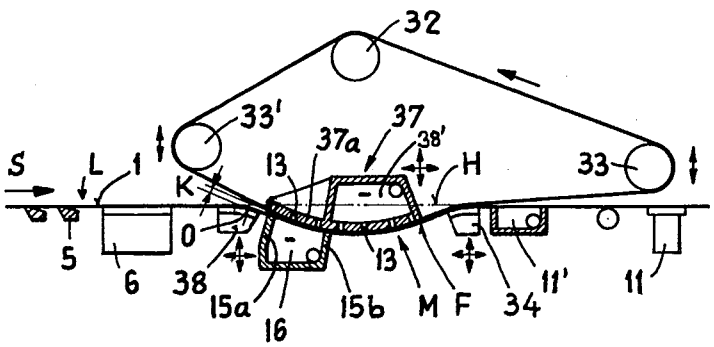

As will be apparent by inspecting FIG. 3, the dewatering region, namely the section or region M, also can extend over a downwardly domed slide or guide surface of a stationary guide element or part 37 immersing beneath the wire plane H, and which slide surface is provided, as shown, with throughflow openings or passages 13. This guide element or part 37 forms at the flow-upstream located inlet portion of the dewatering region M an upwardly open slide guide 37*a* and at the downstream merging remaining portion of the dewatering region M is provided with a suction chamber or box 38' into which open the throughflow openings or passages 13 located at such region. The penetration or immersion depth of the guide element 37 likewise can amount to, for instance, 50 to 180 mm.

The longitudinal wire 1 is guided out of the planar section or portion L over a convex guide surface of a stationary, likewise vertically and horizontally adjustable deflection element 38 towards the slide guide 37*a* which, just as was the case for the suction chamber or box 16, extends over the major portion of the inlet section or portion of the dewatering region. The upper wire 31 is guided towards the slide guide 37*a* by means of a second adjustment roll 33' which is arranged upstream of the guide element or part 37. Also with this arrangement both of the wires 1 and 31 extend in spaced relationship from one another at the height of the wire plane H and are convergingly joined together at a run-on or inbound region which is located downstream of the run-off or outbound location 0. The filtered water which is formed between the suction chamber or box 16 and the run-off location F of the longitudinal wire 1 is sucked through the throughflow openings or passages 13 into the suction chamber or box 38' appropriately withdrawn from such suction box 38' in conventional and therefore here not further illustrated manner.

Figure 4:
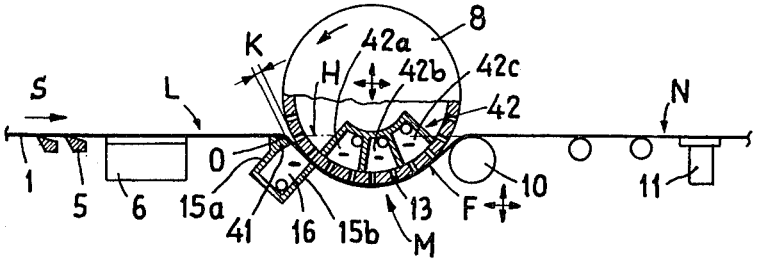

With the embodiment of FIG. 4 the longitudinal wire 1 is guided from the planar portion L downwardly over a stationary deflection part or element 41 connected with the upstream located wall 15*a* of the suction chamber or box 16 and then is guided along the guide surface of the dewatering cylinder 8 towards the deflection roll 10. With an appropriate spacing K between the guide surfaces of the deflection part or element 41 and the dewatering cylinder or element 8 there can be accomplished an adequate load-relief of the longitudinal wire 1 at the inlet portion of the dewatering region already by means of a suction zone of the suction chamber or box 16 which is relatively narrow in the direction of movement S of the longitudinal wire 1, and which, as clearly illustrated in FIG. 4, essentially extends over a starting portion of the inlet section. In corresponding fashion, with this embodiment of the papermaking machine, the longitudinal wire 1 is guided so as to be open throughout the predominant part of the dewatering region over the dewatering cylinder 8. The dewatering cylinder 8 contains a suction chamber or box 42 which is arranged in its internal space or compartment. This suction chamber 42 extends over the portion of the dewatering region M which follows the suction chamber or box 16 downstream thereof. As will be seen from the illustration of FIG. 4, the suction chamber or box 42 can comprise successive partial chambers 42*a*, 42*b* and 42*c* arranged behind one another in the direction of revolving movement of the dewatering roll or cylinder 8, and in which partial chambers there can be generated different vacuum conditions or negative pressures which increase, for instance, in the direction of rotation of the dewatering cylinder or roll 8. The partial chambers 42*a* and 42*b* can serve for augmenting dewatering upwardly and the partial chamber 42*c* can serve for sucking-away the filtered water located in the throughflow openings or passages 13. It should be understood that the suction chamber or box 42 also can possess more than three partial chambers or, however, can be constructed as a one-piece or single compartment arrangement.

Figure 7:
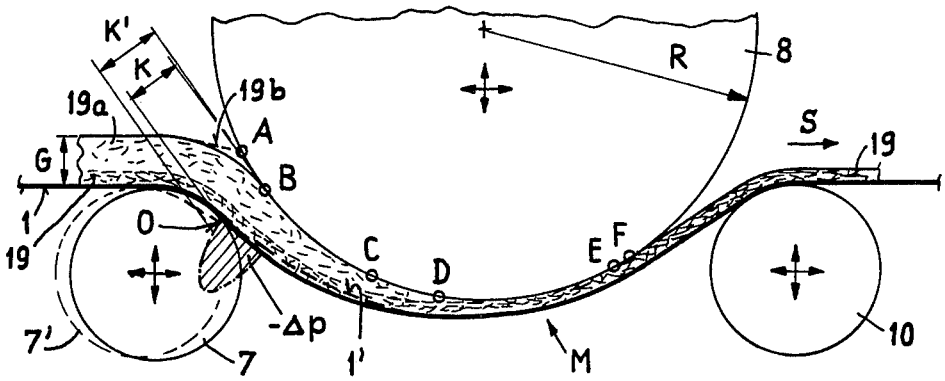
FIG. 7 illustrates a dewatering region according to an embodiment deviating somewhat from the arrangement of FIG. 5 and likewise depicted on an enlarged scale.

As will be apparent from FIG. 7, with a spacing K between the deflection roll 7 and the dewatering cylinder 8, and which spacing K approximately corresponds to the total thickness G of the suspension which is to be infed to the dewatering region, it is possible solely by virtue of the negative pressure $\Delta p$ which builds-up directly after the run-off location 0 of the longitudinal wire 1, and which negative pressure $\Delta p$ forms over the surface portion of the deflection roll 7 merging downstream of the run-off location 0, to obtain a sufficient load-relief of the longitudinal wire 1. By virtue of this relief of the longitudinal wire 1 there is ensured for, in the already described manner, a more intense deflection of the longitudinal wire 1 at the deflection roll 7, and thus, a correspondingly enhanced entry of the fiber stock suspension into the inlet section of the dewatering region M.

The effective region and the course of the negative pressure $\Delta p$ forming at the underside of the longitudinal wire 1 have been shown in the illustration of FIG. 7 by a shaded or hatched area or surface. Under the action of this negative pressure the longitudinal wire 1 is curved more intensely downwardly at the inlet portion of the dewatering region M in relation to the broken line-wire travel course or path 1'. Consequently, the wrap angle of the longitudinal wire 1 at the deflection roll 7, in comparison to the broken line depicted wire travel course or path 1', is increased, and the suspension containing an approximately constant total thickness G impinges at a flat angle at the impact location B upon the guide surface of the dewatering cylinder 8.

Figure 8:
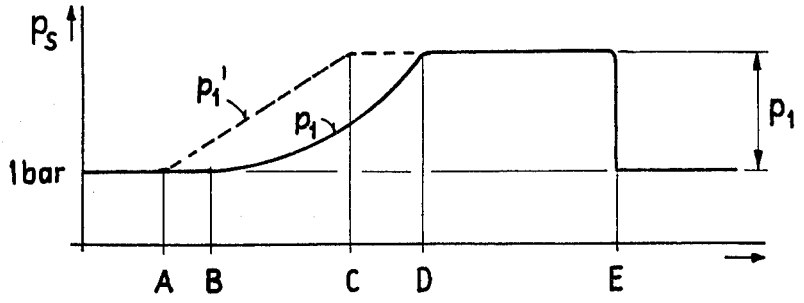
FIG. 8 is a diagram illustrating the approximate course of the suspension pressure within the dewatering region of the arrangement of FIG. 7.

The course of the suspension pressure $p_s = p_1$, which adjusts or regulates itself with this arrangement, has been illustrated in FIG. 8 by the full or solid line $p_1$. The pressure profile or course, illustrated by the broken line $p_1'$, corresponds to an imaginary comparative arrangement with the wire travel course 1' depicted in broken lines in FIG. 7 and with a larger spacing K' between the dewatering cylinder or roll 8 and the deflection roll 7'. With this comparative arrangement the surface portion of the deflection roll 7' which directly merges at the run-off or outbound location of the longitudinal wire 1 is located externally of the inlet gap for the suspension which is formed between the dewatering cylinder 8 and the longitudinal wire 1. Hence, there can be present a negative pressure which is built-up over this surface portion which is not effective in the sense of the previously described load-relief of the longitudinal wire 1. Hence, the suspension of such comparative arrangement impinges at a relatively steep angle at the circumferential location A of the dewatering cylinder 8. This has been prevented by the arrangement depicted in solid or full lines in FIG. 7.

Finally, it is to be mentioned that still other constructional embodiments are possible without departing from the underlying principles and concepts of the present invention. Thus, for instance, at the region of the pre-dewatering path, namely the section or portion L, there can be provided a second headbox for forming a second fiber layer or ply, and by means of the inventive arrangement there is particularly improved the dewatering of the second upper fiber layer or ply.

In order to prevent propelling of the filtered water out of the dewatering cylinder with the embodiments corresponding to the illustrations of FIGS. 1 and 2, such dewatering cylinder also can be provided at its inner side or surface with a suction chamber which is, for instance, open towards the pressure chamber 18.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A longitudinal wire papermaking machine comprising:

a longitudinal wire movable along a predetermined path of travel;

a headbox for infeeding a fiber stock suspension onto said longitudinal wire at a pre-dewatering region thereof in order to form a fiber web;

said pre-dewatering region of the longitudinal wire being formed by an essentially horizontally extending and essentially planar portion of the longitudinal wire;

a convex domed first deflection element;

a downwardly domed dewatering element following said first deflection element in spaced relationship;

said spaced relationship providing a distance measured between outer surfaces of the first deflection element and dewatering element of about one to five times the total thickness of the fiber stock suspension travelling over the pre-dewatering region towards the first dewatering element and comprising the thickness of the fiber web plus the thickness of a layer of stock suspension fluid of the fiber stock suspension reposing on the fiber web;

said downwardly domed dewatering element having a guide surface defined by its outer surface which is water pervious over at least a portion of its curved direction of extent;

an upwardly domed second deflection element;

the longitudinal wire at a dewatering region following the essentially planar portion thereof, viewed with respect to the direction of travel of the longitudinal wire, being guided downwardly over said convex domed first deflection element and after bridging a distance between said first deflection element and said downwardly domed dewatering element being guided upwardly by means of the downwardly domed dewatering element towards said upwardly domed second deflection element;

said longitudinal wire extending essentially in the same wire plane before said first deflection element and after said second deflection element;

means defining a negative pressure zone; and said longitudinal wire having a lower side facing away from said dewatering element and which is guided over said negative pressure zone at least in an initial portion of an inlet section of the dewatering region situated upstream of the lowest deflection location of the longitudinal wire with respect to the wire plane and immediately downstream and subsequent to a wire run-off location at the first deflection element.

2. The papermaking machine as defined in claim 1, wherein:

said first deflection element and said dewatering element are arranged at said spaced relationship from one another which measured between their outer surfaces amounts to about 15 to 80 mm; and said negative pressure zone extending over a portion of a travel surface of the first deflection element which merges at the run-off location of the longitudinal wire downstream with respect to its direction of wire movement.

3. The papermaking machine as defined in claims 1 or 2, wherein:

said negative pressure zone extends over a suction opening of a suction chamber which can be applied to the underside of the longitudinal wire; and said suction opening of said suction chamber extends upstream substantially to said wire run-off location of said longitudinal wire at said first deflection element.

4. The papermaking machine as defined in claim 3, wherein:

said suction chamber comprises an upstream located boundary wall which is sealingly connected with the first deflection element.

5. The papermaking machine as defined in claim 3, wherein:

said suction chamber comprises an upstream located boundary wall which is arranged between the first deflection element and the lowest deflection location of the longitudinal wire and facing the longitudinal wire at the region of said initial portion.

6. The papermaking machine as defined in claim 3, wherein:

said suction chamber comprises a downstream located boundary wall which is arranged upstream of the lowest deflection location of the longitudinal wire.

7. The papermaking machine as defined in claim 3, wherein:

said suction chamber comprises a downstream located boundary wall which is arranged downstream of the lowest deflection location of the longitudinal wire.

8. The papermaking machine as defined in claim 1, wherein:

said dewatering element comprises an open roll having a diameter of approximately 600 to 1500 mm.

9. The papermaking machine as defined in claim 8, further including:

at least one open suction chamber provided for said open roll; and said open suction chamber being open towards a region of a guide surface thereof which neighbors the negative pressure zone at a location downstream thereof.

10. The papermaking machine as defined in claim 1, wherein:

said dewatering element comprises a guide part which is stationary with respect to said longitudinal wire;

said guide part having a guide surface neighboring the negative pressure zone at a location downstream thereof;

the guide part being provided at the region of said guide surface which neighbors the negative pressure zone downstream thereof with throughflow openings for filtered water which is upwardly formed during a dewatering operation and with at least one suction chamber into which open the throughflow openings.

11. The papermaking machine as defined in claim 1, further including:

a pressure chamber open towards said lower side of said longitudinal wire facing away from the dewatering element; and said longitudinal wire being guided at a section of the dewatering region located downstream of the negative pressure zone over said open pressure chamber.

12. The papermaking machine as defined in claim 1, further including: a further wire;

said further wire together with said longitudinal wire conjointly wrapping about said dewatering element; and said further wire being guided in spaced relationship from a portion of the longitudinal wire which extends over the first deflection element so as to converge towards a run-on portion of the longitudinal wire located downstream of the run-off location.

13. The papermaking machine as defined in claim 1, wherein:

said convex domed first deflection element has a water-impervious guide surface.

14. The papermaking machine as defined in claim 5, wherein:

said dewatering element has an impingement location for the fiber web located between a wire run-off location disposed at the first deflection element and said lowest deflection location of the longitudinal wire; and said boundary wall being located upstream of said impingement location.

* * * * *